US010174712B2

(12) United States Patent
Scharp et al.

(10) Patent No.: US 10,174,712 B2
(45) Date of Patent: Jan. 8, 2019

(54) PISTON FOR AN INTERNAL COMBUSTION ENGINE

(71) Applicant: Mahle International GmbH, Stuttgart (DE)

(72) Inventors: Rainer Scharp, Vaihingen (DE); Peter Kemnitz, Leutenbach (DE)

(73) Assignee: Mahle International GmbH (DE)

( * ) Notice: Subject to any disclaimer, the term of this patent is extended or adjusted under 35 U.S.C. 154(b) by 30 days.

(21) Appl. No.: 14/894,339

(22) PCT Filed: May 28, 2014

(86) PCT No.: PCT/DE2014/000265

§ 371 (c)(1),
(2) Date: Nov. 25, 2015

(87) PCT Pub. No.: WO2014/190964

PCT Pub. Date: Dec. 4, 2014

(65) Prior Publication Data

US 2016/0123273 A1 May 5, 2016

(30) Foreign Application Priority Data

May 31, 2013 (DE) ..... 10 2013 009 155

(51) Int. Cl.
*F02F 3/22* (2006.01)
*F02F 3/18* (2006.01)

(52) U.S. Cl.
CPC . *F02F 3/22* (2013.01); *F02F 3/18* (2013.01)

(58) Field of Classification Search
CPC ..... F02F 3/22; F02F 3/18; F02F 3/26; F02F 3/28; F02F 2003/0007; F16J 1/001; F02B 23/06; F02B 23/0672
USPC ..... 123/193.6; 92/888.04
See application file for complete search history.

(56) References Cited

U.S. PATENT DOCUMENTS 5,934,174 A * 8/1999 Abraham, Sr. ..... B23P 15/10 123/193.6
6,763,757 B2 7/2004 Huang et al.
6,892,689 B2 5/2005 Bischofberger et al.
7,308,850 B2 * 12/2007 Scharp ..... F16J 1/09 92/186

(Continued)

FOREIGN PATENT DOCUMENTS

DE 2020058 A1 11/1971
DE 91162 C 7/1972

(Continued)

OTHER PUBLICATIONS

Japanese Office Action dated Jan. 30, 2018 related to corresponding Japanese Patent Application No. JP 2016-515654.
German Search Report for DE-102013009155.1, dated Jul. 10, 2013.
English abstract for DE-102012025536.

*Primary Examiner* — Grant Moubry
(74) *Attorney, Agent, or Firm* — Fishman Stewart PLLC

(57) ABSTRACT

A piston for an internal combustion engine may include a piston crown and a piston skirt. The piston crown may include a piston head, a peripheral top land, a peripheral annular zone having a plurality of annular grooves and an annular closed cooling channel. The cooling channel may include a cooling channel base and a cooling channel cover. The cooling channel base may be arranged above the lower annular groove in relation to a region of combustion.

20 Claims, 2 Drawing Sheets

(56) References Cited

U.S. PATENT DOCUMENTS

| | | | | |
|---|---|---|---|---|
| 8,689,743 | B2 * | 4/2014 | Scharp | F02F 3/22 123/193.6 |
| 9,228,530 | B2 * | 1/2016 | Kodama | F02F 3/22 |
| 9,242,317 | B2 | 1/2016 | Scharp et al. | |
| 9,382,869 | B2 * | 7/2016 | Freidhager | B22C 9/105 |
| 2004/0231631 | A1 * | 11/2004 | Scharp | F02F 3/22 123/193.6 |
| 2005/0283976 | A1 | 12/2005 | Otaka | |
| 2008/0121205 | A1 | 5/2008 | Scharp | |
| 2011/0107997 | A1 * | 5/2011 | Muscas | F02F 3/003 123/193.6 |
| 2013/0014723 | A1 | 1/2013 | Bucher | |
| 2013/0032103 | A1 | 2/2013 | Azevedo | |
| 2013/0206095 | A1 * | 8/2013 | Azevedo | F16J 1/09 123/193.6 |
| 2013/0213218 | A1 | 8/2013 | Kaiser et al. | |

FOREIGN PATENT DOCUMENTS

| | | | | |
|---|---|---|---|---|
| DE | 10063568 | A1 | 7/2002 | |
| DE | 10110889 | C1 | 10/2002 | |
| DE | 102004057558 | A1 | 6/2006 | |
| DE | 102010051681 | A1 | 5/2012 | |
| DE | 102012025536 | A1 | 6/2014 | |
| EP | 0178747 | A1 | 4/1986 | |
| EP | 0397710 | B1 * | 11/1993 | F02B 23/0696 |
| JP | S57-8335 | U | 1/1982 | |
| JP | S61-73046 | U | 5/1986 | |
| JP | S64-41648 | U | 3/1989 | |
| JP | H05-312104 | A | 11/1993 | |
| JP | 2005-194971 | A | 7/2005 | |
| WO | 2013/007237 | A1 | 1/2013 | |

* cited by examiner

PISTON FOR AN INTERNAL COMBUSTION ENGINE

CROSS-REFERENCE TO RELATED APPLICATIONS

This application claims priority to German Patent Application No. 102013009155.1, filed May 31, 2013, and International Patent Application No. PCT/DE2014/000265, filed May 28, 2014, both of which are hereby incorporated by reference in their entirety.

TECHNICAL FIELD

The present invention relates to a piston for an internal combustion engine, comprising a piston crown and a piston skirt, wherein the piston crown has a piston head, a peripheral top land, a peripheral annular zone with annular grooves and, in the region of the annular zone, a peripheral closed cooling channel with a cooling channel base and a cooling channel cover.

BACKGROUND

In modern internal combustion engines, the pistons are always exposed to higher temperature loadings in the region of the piston head and of the combustion recess. An inadequate dissipation of heat from the piston crown results in functional impairments of the piston, in particular in coking or carbon deposits on the piston, during operation of the engine. This applies in particular to pistons composed of steel materials since steel has a low coefficient of heat conductivity and is therefore a poor heat conductor.

SUMMARY

It is the object of the present invention to develop a piston of the type in question in such a manner that an optimized dissipation of heat from the piston crown takes place during the operation of the engine.

The solution consists in that the cooling channel base is arranged above the lowest annular groove.

In conventional pistons, the cooling channel as a rule extends in the axial direction as far as the level of the lowest annular groove and thereunder in order, with the aid of as large a cooling channel as possible, to achieve adequate cooling in particular of steel pistons during operation of the engine. On account of the shaker effect, the cooling oil moves to and fro between the cooling channel cover, i.e. a very hot region, and the cooling channel base, i.e. a comparatively cool region. Due to the significantly lower temperatures in the region of the cooling channel base, there is virtually no longer any absorption of heat from the piston crown into the cooling oil. Furthermore, due to the small heat gradient in the direction of the annular zone and piston skirt, only a comparatively small dissipation of heat from the cooling oil takes place.

By contrast, the piston according to the invention is distinguished in that the cooling channel is shortened in the axial direction in comparison to conventional pistons. This has the consequence that the cooling oil, in particular in the region of the cooling channel base, moves in greater proximity to the highly heat-loaded cooling channel base and therefore overall in hotter regions than is the case in conventional pistons. Therefore, in every phase of the piston movement, heat is absorbed from the hot regions of the piston crown into the cooling oil. In particular if the quantity of cooling oil known from conventional pistons is retained and the cooling oil supply is designed in such a manner that the cooling oil is rapidly interchanged during operation of the engine, significantly improved cooling of the piston crown arises in comparison to conventional pistons.

Advantageous developments emerge from the dependent claims.

The cooling channel base is preferably arranged between the first annular groove and the second annular groove in order further to increase the cooling capacity by the cooling oil moving in even greater proximity to the hot piston head during operation of the engine.

An at least partially peripheral recess is expediently introduced into the piston crown below the cooling channel base into the piston crown. The piston mass is significantly reduced as a result.

In a further preferred development, the height of the top land is at maximum 9% of the nominal diameter of the piston crown. The cooling channel is therefore positioned with respect to the piston head and the annular zone in a particularly advantageous manner for dissipating heat.

In this case, the distance between the piston head and the cooling channel base can be between 11% and 17% of the nominal diameter of the piston crown. In addition or instead, the height of the cooling channel can be 0.8 times to 1.7 times the width thereof. Furthermore, alternatively or cumulatively with respect thereto, the distance between the piston head and the cooling channel cover can be between 3% and 7% of the nominal diameter of the piston crown. These dimension rules permit an optimized configuration and positioning of the cooling channel for all piston sizes.

The compression height can be, for example, between 38% and 45% of the nominal diameter of the piston crown.

A further particularly preferred embodiment consists in that a combustion recess is formed in the piston head, and in that the smallest wall thickness in the radial direction between the combustion recess and the cooling channel is between 2.5% and 4.5% of the nominal diameter of the piston crown. An improved transfer of heat between the combustion recess and the cooling channel is therefore achieved.

The combustion recess can be provided, for example, with an undercut in order to determine the wall thickness between the combustion recess and the cooling channel.

The recess below the cooling channel base preferably has a U-shaped or oval cross section in order to avoid the formation of sharp edges and therefore to minimize the risk of mechanical stresses in the material.

The piston according to the invention can be designed as a single-part piston, or the piston can be composed, for example, of at least two components connected nonreleasably to each other. In particular, the piston according to the invention can have a piston basic body and a peripheral recess edge reinforcement. The piston according to the invention can also have, for example, a piston basic body and a peripheral piston head element.

The present invention is suitable in particular for pistons composed of at least one steel material.

BRIEF DESCRIPTION OF THE DRAWINGS

Exemplary embodiments of the present invention are explained in more detail below with reference to the attached drawings. In a schematic illustration not true to scale.

DETAILED DESCRIPTION

Figure 1:
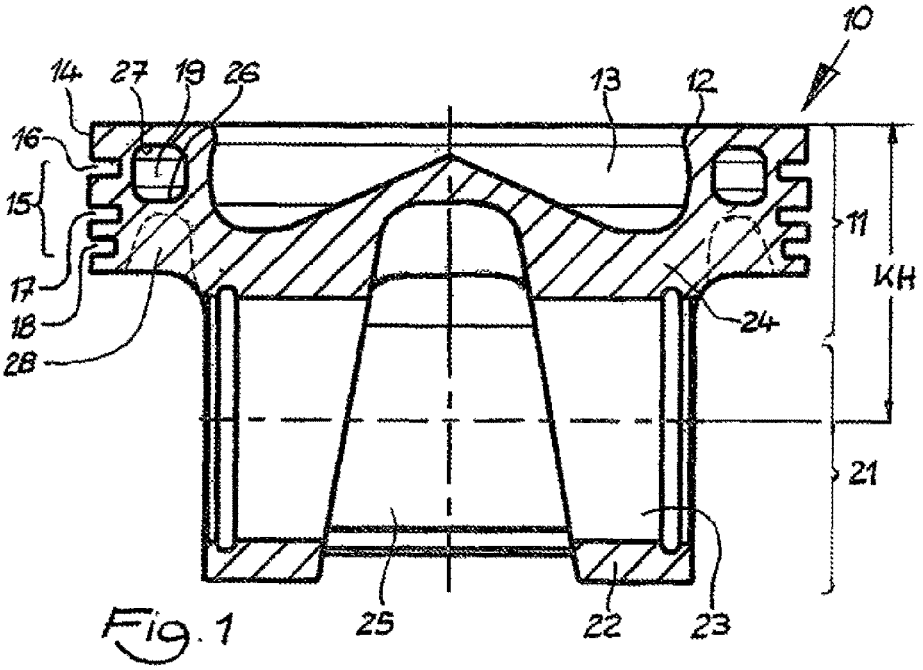
FIG. 1 shows a first exemplary embodiment of a piston according to the invention in section.

FIG. 1 shows a first exemplary embodiment of a piston 10 according to the invention. In the exemplary embodiment, the piston 10 is a single-part piston cast in a manner known per se with the aid of a salt core. In the exemplary embodiment, the piston 10 is produced from a steel material.

The piston 10 has a piston crown 11 with a piston head 12 having a combustion recess 13, a peripheral top land 14 and an annular zone 15 with annular grooves 16, 17, 18 for receiving piston rings (not illustrated). A peripheral closed cooling channel 19 is provided level with the annular zone 15.

The piston 10 furthermore has a piston skirt 21 with piston bosses 22 and boss bores 23 for receiving a piston pin (not illustrated). The piston bosses 22 are connected to the lower side of the piston crown 11 via boss connections 24. The piston bosses 22 are connected to one another via running surfaces 25.

The cooling channel 19 has a cooling channel base 26 and a cooling channel cover 27. In the exemplary embodiment, the cooling channel base 26 is arranged approximately between the first annular groove 16 and the second annular groove 17. An at least partially peripheral recess 28 is introduced into the piston crown 11 below the cooling channel base 26 in the exemplary embodiment. In the exemplary embodiment, the recess 28 has an approximately U-shaped cross section.

The recess 28 can be incorporated into the piston crown 11 by a forging process. In this case, the recess 28 is provided only above the running surfaces 25 of the piston 10 because the forging tool has too little movement clearance above the piston bosses 22. Of course, it is possible to finish the piston 10 in the region above the piston bosses 22 by means of chip-removing processes in order to obtain a fully peripheral recess 28 (indicated in FIG. 2 by dashed lines).

In the exemplary embodiment, the compression height KH is between 38% and 45% of the nominal diameter DN of the piston crown 11.

Figure 2:
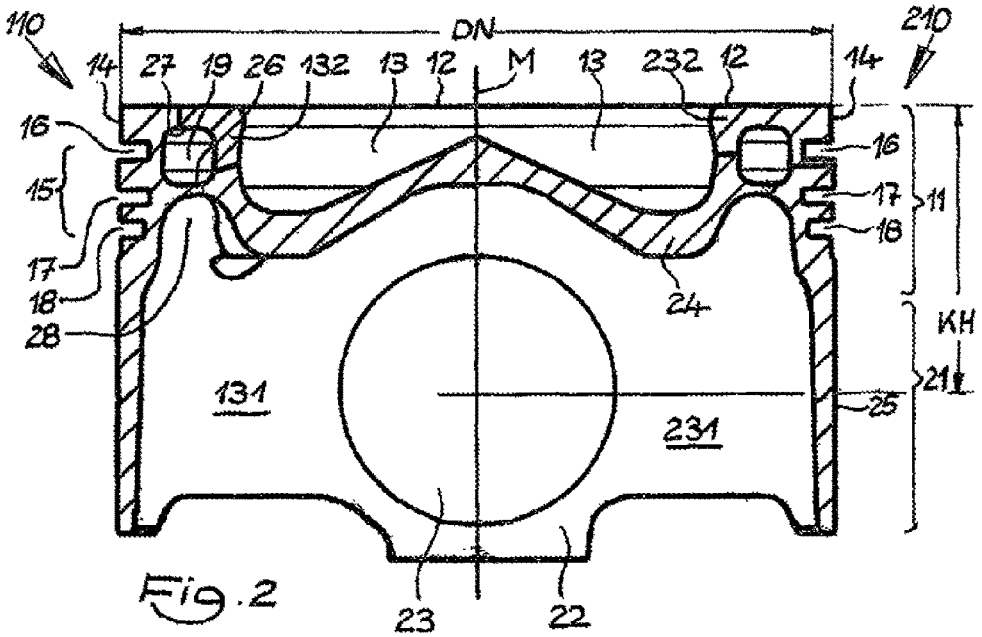
FIG. 2 shows an overall illustration of two further exemplary embodiments of the piston according to the invention in section.

FIG. 2 shows, in an illustration rotated through 90° relative to FIG. 1, an overall view of two further exemplary embodiments of pistons 110, 210 according to the invention. The illustrations of the respective exemplary embodiments are separated by the center line M.

The pistons 110, 210 are constructed in a similar manner as the piston 10 according to FIG. 1. Corresponding structural elements are therefore provided with the same reference signs, and reference is made in this regard to the description for FIG. 1.

The essential difference consists in that the pistons 110, 210 are each composed of two components connected nonreleasably to each other. The piston 110 (illustration on the left of the center line M) consists of a piston basic body 131 and a peripheral recess edge reinforcement 132. In the exemplary embodiment, the recess edge reinforcement comprises the recess edge of the combustion recess 13 and part of the piston head 12. The recess edge reinforcement 132 can be connected to the piston basic body 131 in particular by a welding process, for example electron beam welding or laser welding.

The piston 210 (illustration on the right of the center line M) consists of a piston basic body 231 and a peripheral piston head element 232. In the exemplary embodiment, the piston head element 232 comprises the recess edge of the combustion recess 13, the piston head 12, the top land 14 and the highest annular groove 16. The piston head element 232 can be connected to the piston basic body 231 in particular by a welding process, for example friction welding, electron beam welding or laser welding.

Figure 3:
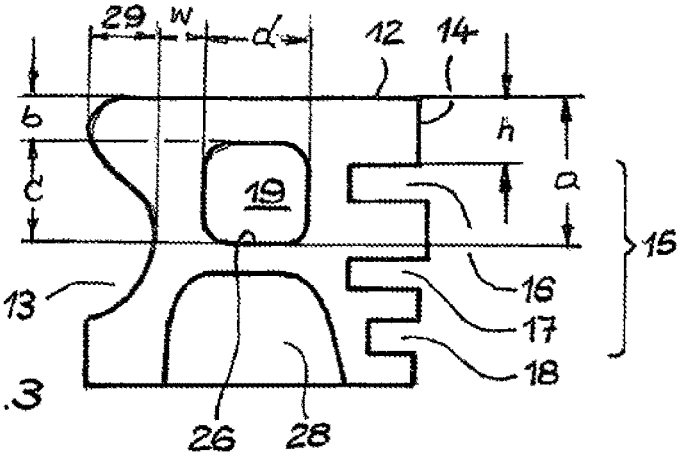
FIG. 3 shows an enlarged partial illustration of the cooling channel and of the annular zone according to FIGS. 1 and 2.
Figure 4A:
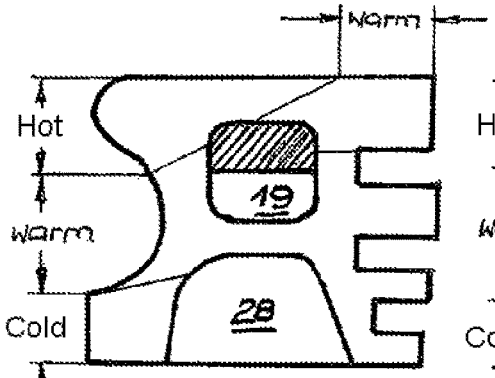
FIGS. 4*a*, 4*b* show a schematic illustration of the movement of cooling oil in a piston according to the present invention.
Figure 4B:
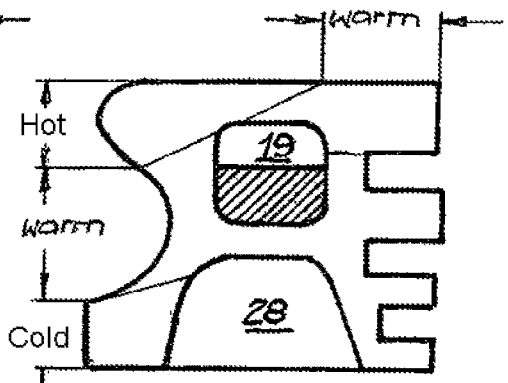

FIG. 3 shows, in an enlarged partial illustration, the cooling channel 19 and the piston head 12, part of the combustion recess 13, the top land 14, the annular zone 15 with the annular grooves 16, 17, 18 of the pistons according to the invention and the recess 28 according to FIGS. 1 and 2.

The combustion recess 13 is provided with an undercut 29 in order to determine the wall thickness between the combustion recess 13 and the cooling channel 19 (see below in this respect).

It is preferred for the height h of the top land 14 to be at maximum 9% of the nominal diameter DN of the piston crown 11 (see FIGS. 1 and 2). The cooling channel 19 is therefore positioned with respect to the piston head 12 and the annular zone 15 in a particularly advantageous manner for dissipating heat.

On the basis of said dimension rules for the top land 14, it is preferred for the distance a between the piston head 12 and the cooling channel base 26 to be between 11% and 17% of the nominal diameter DN of the piston crown 11 (see FIGS. 1 and 2). The cooling channel 19 is therefore positioned in optimum proximity to the hot piston head 12 and in an optimum position relative to the cooler annular grooves 16, 17, 18.

Furthermore, it is preferred for the height c of the cooling channel 19 to be 0.8 times to 1.7 times the width d thereof. This dimensioning rule brings about an optimum volume of the cooling channel 19 and an optimum alignment relative to the hot combustion recess 13, in particular to the recess edge, and to the hot piston head 12 and to the cooler annular grooves 16, 17, 18.

Finally, it is preferred for the distance b between the piston head 12 and the cooling channel cover 27 to be between 3% and 7% of the nominal diameter DN of the piston crown 11 (cf. FIGS. 1 and 2). This dimensioning rule also brings about optimum positioning of the cooling channel 19 with respect to the hot piston head 12.

In conclusion, it is preferred for the smallest wall thickness w in the radial direction between the combustion recess 13 and the cooling channel 19 to be between 2.5% and 4.5% of the nominal diameter DN of the piston crown 11. An improved transfer of heat between the combustion recess 13 and the cooling channel 19 is therefore achieved.

Figure 5A:
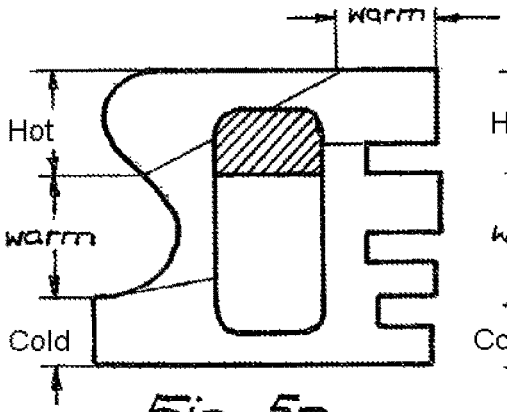
FIGS. 5*a*, 5*b* show a schematic illustration of the movement of cooling oil in a piston according to the prior art.
Figure 5B:
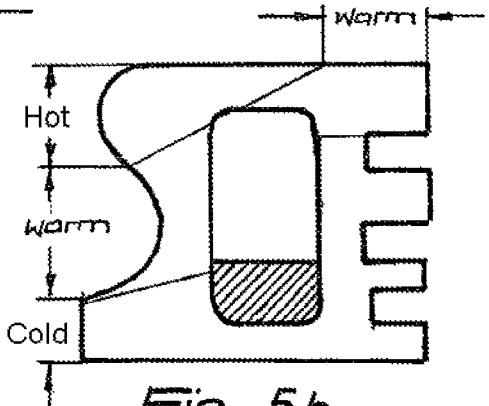

FIGS. 4*a* and 4*b* and 5*a* and 5*b* schematically show the movement of cooling oil during operation of the engine and the temperature zones in the region of the combustion recess, of the piston head, of the cooling channel and of the annular grooves both for a piston according to the invention (FIGS. 4*a* and 4*b*) and for a piston according to the prior art (FIGS. 5*a* and 5*b*).

In FIGS. 4*a*, 4*b*, 5*a*, 5*b*, three heat zones, namely "hot", "warm" and "cool" are denoted schematically. The relative temperature differences in the individual piston regions are thus intended to be illustrated.

According to the present invention (FIGS. 4*a* and 4*b*), the cooling channel is shortened in the axial direction in comparison to the prior art. This has the consequence that the cooling oil moves virtually exclusively along the "hot" regions of the piston head and of the combustion recess. In every phase of the piston movement, heat is therefore absorbed from the "hot" regions of the piston crown into the cooling oil. The quantity of cooling oil known from the prior art is intended to be maintained and the engine management designed in such a manner that the cooling oil is rapidly interchanged during operation of the engine.

In the prior art (FIGS. 5*a* and 5*b*), the cooling channel extends as a rule in the axial direction to level with the lowest annular groove and thereunder in order, with the aid of as large a cooling channel as possible, to achieve adequate cooling during operation of the engine. On account of the shaker effect, the cooling oil moves between a "hot" region, namely the piston head and the recess edge of the combustion recess, and a "cool" region, namely the cooling channel base. Due to the significantly lower temperatures in the region of the cooling channel base, there is virtually no longer any absorption of heat there from the piston crown into the cooling oil.

As a result, significantly improved cooling of the piston crown is produced in the piston according to the invention in comparison with the prior art.

The invention claimed is:

1. A piston for an internal combustion engine, comprising: a piston crown and a piston skirt together defining a reciprocating axis, the piston crown including a piston head, a combustion recess, a peripheral top land, a peripheral annular zone having a plurality of annular grooves and an annular closed cooling channel including a cooling channel base and a cooling channel cover, the cooling channel base arranged above a lowest annular groove of the plurality of annular grooves;

a peripheral recess extending at least partially about the piston crown and disposed below the cooling channel base relative to the piston head;

the piston crown defining a wall thickness in a radial direction with respect to the reciprocating axis between the combustion recess and the cooling channel ranging from 2.5% to 4.5% of a nominal diameter of the piston crown;

wherein the top land defines an axial extent with respect to the reciprocating axis of 9% or less than the nominal diameter of the piston crown; and wherein a distance between the piston head and the cooling channel base in an axial direction of the reciprocating axis is between 11% and 17% of the nominal diameter of the piston crown.

2. The piston as claimed in claim 1, wherein the cooling channel base is arranged between a first annular groove and a second annular groove of the plurality of annular grooves, and wherein the first annular groove and the second annular groove are positioned towards the top land in relation to the lowest annular groove.

3. The piston as claimed in claim 1, wherein the peripheral recess is delimited axially by the cooling channel base, and wherein the peripheral recess has a rounded transition defined between the cooling channel base and a wall of the combustion recess and between the cooling channel base and a wall of the annular zone.

4. The piston as claimed in claim 3, wherein the peripheral recess has at least one of a U-shaped cross-section and an oval cross-section oriented in an axial direction of the reciprocating axis.

5. The piston as claimed in claim 1, wherein the cooling channel defines an axial extent and a radial extent with respect to the reciprocating axis, and wherein the axial extent is between 0.8 times to 1.7 times the radial extent of the cooling channel.

6. The piston as claimed in claim 1, wherein a distance between the piston head and the cooling channel cover is between 3% and 7% of the nominal diameter of the piston crown.

7. The piston as claimed in claim 1, wherein the piston crown and the piston skirt together define a compression height, and wherein the compression height is between 38% and 45% of the nominal diameter of the piston crown.

8. The piston as claimed in claim 1, wherein the combustion recess further includes an undercut, and wherein the wall thickness of the piston crown between the combustion recess and the cooling channel is defined in a region of the undercut.

9. The piston as claimed in claim 1, wherein the piston crown is integral with the piston skirt to define a single-part piston.

10. The piston as claimed in claim 1, wherein the piston crown and the piston skirt collectively are composed of at least two components connected nonreleasably to each other.

11. The piston as claimed in claim 10, wherein the at least two components include at least a piston basic body and a peripheral recess edge reinforcement.

12. The piston as claimed in claim 10, wherein the at least two components include at least a piston basic body and a peripheral piston head element.

13. The piston as claimed in claim 1, wherein at least one of the piston crown and the piston skirt is composed of a steel material.

14. The piston as claimed in claim 1, wherein the wall thickness of the piston crown in the radial direction ranging from 2.5% to 4.5% of the nominal diameter is a minimum wall thickness in the radial direction defined by a wall of the piston crown arranged between the combustion recess and the cooling channel.

15. The piston as claimed in claim 1, wherein the axial extent of the top land of 9% or less than the nominal diameter and the distance between the piston head and the cooling channel base in the axial direction of between 11% and 17% of the nominal diameter are each uniform throughout an extent of the cooling channel in a circumferential direction of the piston crown.

16. A piston for an internal combustion engine, comprising:

a piston crown and a piston skirt together defining a reciprocating axis;

the piston crown including a piston head, a combustion recess, a peripheral top land, a peripheral annular zone including a plurality of annular grooves, and an annular closed cooling channel disposed radially inwards from the annular zone in relation to the reciprocating axis, the cooling channel including a cooling channel base and a cooling channel cover, wherein the cooling channel base is arranged above a lowermost annular groove of the plurality of annular grooves with respect to the piston head;

the piston skirt including piston bosses connected to one another via running surfaces;

a peripheral recess disposed below the cooling channel base at least in a region of the running surfaces of the piston skirt, wherein the peripheral recess is open axially in a direction away from the cooling channel;

wherein the combustion recess includes an undercut, and the piston crown defines a wall thickness in a radial direction with respect to the reciprocating axis between a region of the undercut of the combustion recess and the cooling channel ranging from 2.5% to 4.5% of a nominal diameter of the piston crown;

wherein the top land defines an axial extent with respect to the reciprocating axis of 9% or less than the nominal diameter of the piston crown;

wherein the cooling channel defines an axial extent and a radial extent with respect to the reciprocating axis, the axial extent being between 0.8 times to 1.7 times the radial extent of the cooling channel;

wherein a distance between the piston head and the cooling channel cover in an axial direction of the reciprocating axis is between 3% and 7% of the nominal diameter of the piston crown; and wherein a distance between the piston head and the cooling channel base in the axial direction is between 11% and 17% of the nominal diameter.

17. The piston as claimed in claim 16, wherein the piston crown and the piston skirt are structured as at least two components connected nonreleasably to each other.

18. The piston as claimed in claim 17, wherein the at least two components are secured to one another via a welded connection.

19. The piston as claimed in claim 16, wherein the peripheral recess extends completely around the piston crown in a circumferential direction of the reciprocating axis.

20. The piston as claimed in claim 16, wherein the axial extent of the top land of 9% or less than the nominal diameter, the axial extent of the cooling channel of 0.8 times to 1.7 times the radial extent of the cooling channel, the distance between the piston head and the cooling channel cover in the axial direction of between 3% and 7% of the nominal diameter, and the distance between the piston head and the cooling channel base in the axial direction of between 11% and 17% of the nominal diameter are each uniform throughout an extent of the cooling channel in a circumferential direction of the piston crown.

* * * * *